United States Patent [19]

Lilov et al.

[11] Patent Number: 4,793,815

[45] Date of Patent: Dec. 27, 1988

[54] ELECTRICAL CONNECTOR

[75] Inventors: Lev Lilov, Royal Oak; Joseph C. Guck, Garden City, both of Mich.

[73] Assignee: Ford Motor Company, Dearborn, Mich.

[21] Appl. No.: 50,813

[22] Filed: May 18, 1987

[51] Int. Cl.[4] ..... H01R 9/09

[52] U.S. Cl. ..... 439/77; 439/325; 439/499

[58] Field of Search ..... 439/64, 77, 81, 59, 439/62, 325, 327, 499

[56] References Cited

U.S. PATENT DOCUMENTS

| | | | |
|---|---|---|---|
| 3,069,753 | 12/1962 | Lalmond et al. | 439/77 |
| 4,474,420 | 10/1984 | Nestor | 439/77 |
| 4,581,495 | 4/1986 | Geri et al. | 439/77 |
| 4,640,561 | 2/1987 | George | 339/17 F |
| 4,695,108 | 9/1987 | Ichitsubo | 439/77 |
| 4,744,764 | 5/1988 | Rubenstein | 439/77 |

FOREIGN PATENT DOCUMENTS

| | | | |
|---|---|---|---|
| 3430573 | 2/1986 | Fed. Rep. of Germany | 439/77 |

*Primary Examiner*—Gil Weidenfeld
*Assistant Examiner*—Paula A. Austin
*Attorney, Agent, or Firm*—Paul K. Godwin, Jr.; Clifford L. Sadler

[57] ABSTRACT

An electrical connector which provides a positive interconnection between the exposed conductor runs of a flexible printed circuit film and corresponding conductors on a printed circuit board by utilizing an insulated block mounted on the printed circuit board for holding a plurality of spring contacts and providing a holding mechanism adjacent the flexible printed circuit film so that compression between the electrical contacts and the exposed runs is maintained.

7 Claims, 2 Drawing Sheets

FIG. 2.
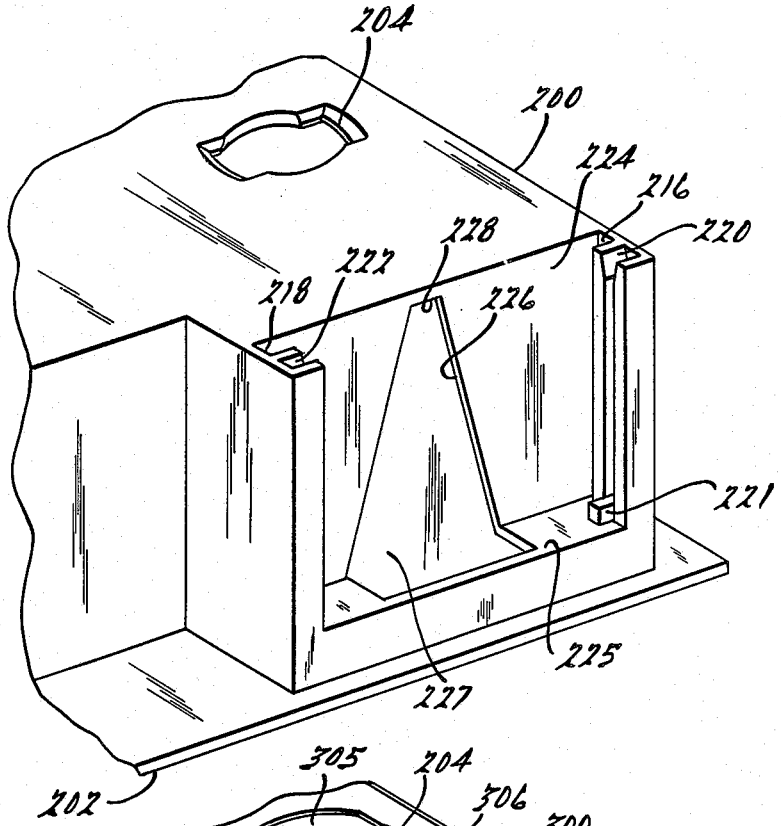
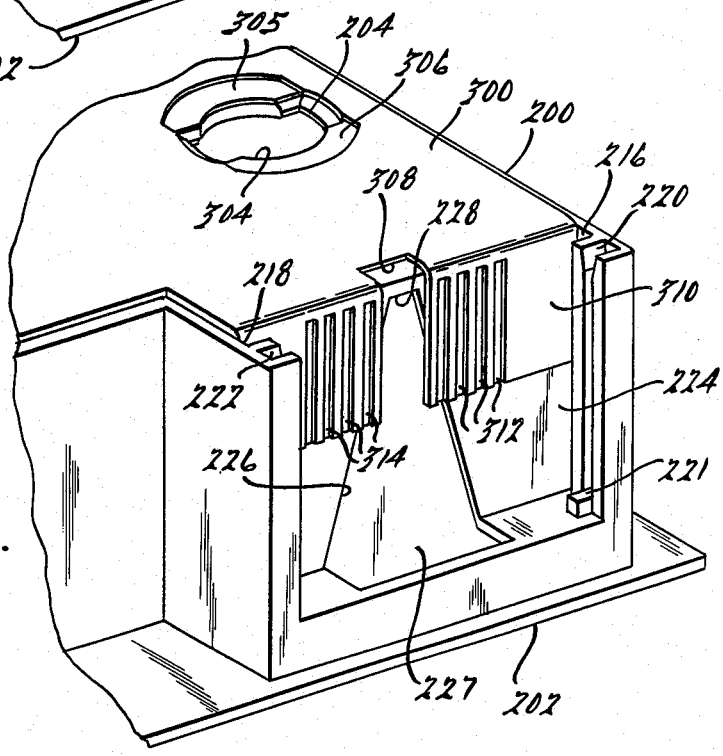
FIG. 3.

ELECTRICAL CONNECTOR

BACKGROUND OF THE INVENTION

1. Field of the Invention

The present invention is directed to the field of electrical connectors and, more specifically, is directed to the area of providing electrical connections to exposed conductor runs on a flexible printed circuit film.

2. Description of the Prior Art

In automotive instrument panel applications, the use of flexible printed circuit films is well known as providing a lightweight, reliable and low cost means of distributing electrical energy to various indicator lamps and instrument terminals that are interconnected with the film. Commonly assigned U.S. Pat. No. 4,640,561 describes a flexible printed circuit connector which is configured to be inserted into an aperture underlying the flexible printed circuit film layer, to make electrical contact with the exposed conductors thereof and provide a receptacle socket for a male pin conductor of an associated instrument.

SUMMARY OF THE INVENTION

It has become more and more desirable to provide integrated circuits and other electronic components in modular form on the instrument panel location to provide, for instance, switching control for warning indicators. However, such electronic components could not be readily serviced if they were permanently attached to the surface of the flexible printed circuit film. Accordingly, it was viewed that a mechanism was needed to provide removable interconnection between the conductors on the printed circuit film and corresponding terminals of a printed circuit board that carries the electronic components providing the desired control features.

The present invention provides a removable connection between exposed conductor runs on a flexible printed circuit film and corresponding conductors on a rigid printed circuit board.

The present invention further provides an insulated block member with a plurality of spring contacts extending from a first surface thereof. The insulated block member is mounted on a printed circuit board and the spring contacts are arrayed to correspond with the exposed conductor runs on a flexible printed circuit film and mated therewith.

The present invention also provides a rigid means for supporting the flexible printed circuit film and backing the exposed conductor runs so that the conductor runs will be compressed between the spring contact members and the backing for positive contact.

The present invention further includes holding means which extend from the rigid means backing the flexible printed film for guiding the insertion of the board and compressing the spring contacts against the exposed conductor runs.

The present invention additionally includes a means for releasably latching the printed circuit board in place within the holding means so that it may be subsequently removed for servicing, if necessary.

BRIEF DESCRIPTION OF THE DRAWINGS

FIG. 2 is a perspective view of the rear portion of a relatively rigid instrument panel housing which incorporates retaining slots for the printed circuit board shown in FIG. 1.

FIG. 3 is a perspective view of the element shown in FIG. 2 with a flexible printed circuit film shown overlaying the surface thereof.

DETAILED DESCRIPTION OF THE PREFERRED EMBODIMENT

Figure 1:
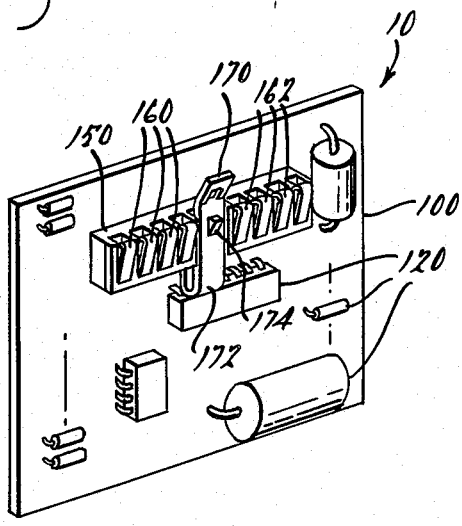
FIG. 1 is a representation of a relatively rigid printed circuit board containing the preferred embodiment of the electrical contact portions of the present invention.

In FIG. 1, an electronic module 10 is shown as comprising a substrate 100 that is generally referred to as a rigid printed circuit board with several electrical and electronic components 120 mounted thereon, in a conventional manner. An insulator block member 150 is formed as a unitary structure and is mounted to the printed circuit board in a predetermined location so that it will mate with exposed conductor runs on a flexible printed film, such as is shown in FIG. 3.

The insulated block member 150 contains an array of electrical contact elements 160 and 162 that are disposed on either side of a ramped latching tab 174. The ramped latching tab 174 is provided on a cantilever arm 172 so as to protrude into a depression after passing a resistance edge 228 on the housing shown in FIG. 3.

A manual release lever 170 is located at the extreme end of the cantilever arm 172 so as to provide a releasing mechanism.

Although not shown in detail, the printed circuit board 100 contains a printed circuit pattern to provide interconnection between the various components thereon and the electrical contacts 160 and 162. Spring contacts 160 and 162 are formed so as to be biased outwardly from the insulator block 150 and are solder connected to corresponding printed circuit board terminals to provide the necessary connections.

In FIG. 2, a rigid housing member 200 is shown. The housing member 200 is similar to those conventionally found as rear elements of instrument panels on automotive vehicles. The housing 200 contains a conventional socket aperture 204 for receiving indicator lamps for illumination of the interior of the housing 200. A front flange 202 extends from the housing 200 and provides an area onto which the printed circuit board 100 may be retained. The retaining elements (holding means) formed in the housing include a pair of vertical grooves 220 and 222 which extend parallel to a sidewall 224. The sidewall 224 provides backing to the flexible printed circuit film layer, which is further described with respect to Figure 3. The vertical grooves 220 and 222 are separated from the sidewall 224 by spacers 216 and 218. A retaining resistance edge 228 is formed in the sidewall 224 as a recess.

Since it is desired to maintain a substantial seal to the inside of the instrument panel housing 200, the sidewall 224 contains a recessed surface 227, in this case. The truncated edges 226 leading up to the recessed edge 228 are formed during molding, in order to provide a low resistance to the removal of a molding tool.

Otherwise, those edges should not be viewed as a limiting feature of the invention. Limiting blocks 221 223 are located at the ends of the grooves 220 and 222 so as to limit the insertion distance of the printed circuit board into the vertical grooves 220 and 222. The stops 221 and 223 are molded in place and supported by the formed base wall 225 which intersects sidewall 224.

FIG. 3 illustrates the housing 200 shown in FIG. 2 with the flexible printed circuit film 300 precisely located and overlaying the rear surface thereof. The aperture 304 of the flexible printed circuit film 300 is shown as being concentric with the socket aperture 204; and contains exposed electrical conductor portions 305 and 306 so that an inserted lamp will make electrical contact therewith.

The flap 310 of the flexible printed circuit film 300 contains several exposed conductor runs designated as 312 and 314 that overlaying the sidewall 224 and are backed thereby. The flap 310 is fitted into the spacer grooves 216 and 218. It contains a cut out portion 308 that allows for the recessed edge 228 to be exposed for latching when the printed circuit board 100 is inserted in the grooves 220 and 222.

Figure 4:
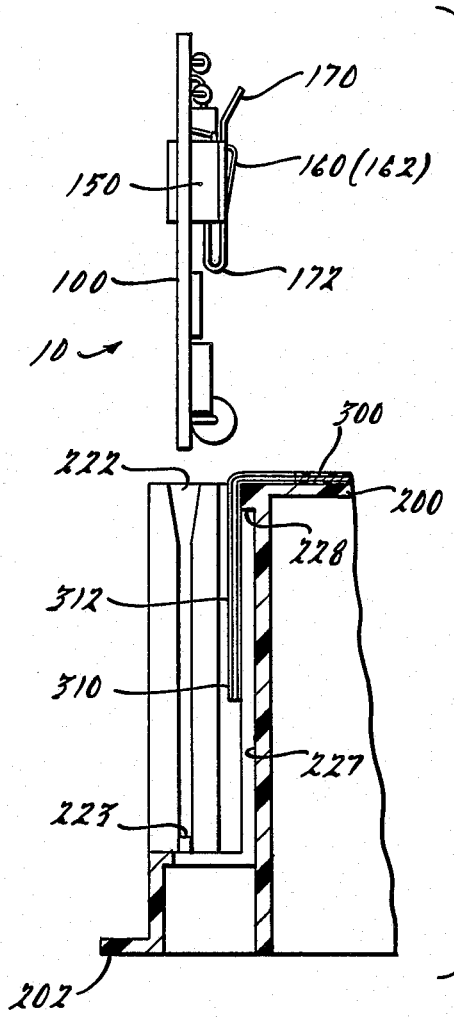
FIG. 4 is a cross-sectional view of the retaining element and the flexible printed circuit film shown in FIG. 3 positioned to receive the printed circuit board shown in FIG. 1.

In FIG. 4, the electronic module 10 is illustrated as being aligned with the grooves 222 (220) for insertion therein. As can be seen, when the printed circuit board 100 is inserted into the grooves 222 (220) it is guided thereby and the spring contacts 160 and 162 are compressed against the exposed conductor runs 312 and 314 on the flap 310 of the flexible printed circuit film 300.

Upon reaching full insertion, the ramped tab 174 will snap into a position abutting the resistance edge 228 so as to retain the entire printed circuit board 100 within the holding means. In order to release the printed circuit board 100 for removal to break the connection, the release lever 170 is compressed towards the printed circuit board 100 so as to remove the interference fit between the ramped tab 174 and the resistance edge 228.

It is apparent that the major advantage of having an electrical connector such as described herein is that the entire module assembly may be installed on the instrument panel with the use of relatively unsophisticated robotic techniques since it relies on a linear insertion movement.

It will further be apparent that many modifications and variations may be implemented without departing from the scope of the novel concept of this invention. Therefore, it is intended by the appended claims to cover all such modifications and variations which fall within the true spirit and scope of the invention.

We claim:

1. An electrical connector for providing a removable connection between exposed conductor runs on a flexible printed circuit film layer and corresponding conductors on a rigid printed circuit board, comprising:

an insulated block member;

a plurality of spring contacts extending from a first surface of said insulated block member;

a printed circuit board for supporting said insulated block member and said spring contacts extending therefrom in an exposed condition;

rigid means for supporting said flexible printed circuit film layer and backing said exposed conductor runs;

holding means extending from said rigid means for retaining said printed circuit board in a position for compressing said spring contacts against said exposed conductor runs of said flexible printed circuit film layer backed by said rigid means.

2. An electrical connector as in claim 1, wherein said plurality of spring contacts are connected through said insulated block to corresponding conductor runs on said printed circuit board.

3. An electrical connector as in claim 2, wherein said holding means contains a means for slidably accepting said printed circuit board to be inserted therein at a distance from said rigid means backing said flexible printed circuit film layer so that said spring contacts are compressed against said exposed conductor runs on said flexible printed circuit film layer when said printed circuit board is inserted.

4. An electrical connector as in claim 3, wherein said insulated block contains a means for latching said printed circuit board, spring contacts and insulated block within said holding means when fully inserted within said accepting means.

5. An electrical connector as in claim 4, wherein said latching means includes a cantilevered ramp element and said rigid means contains an aperture through which said ramped element protrudes when said printed circuit board is fully inserted into said accepting means.

6. An electrical connector system that allows a relatively rigid printed circuit board to be removably connected to exposed conductor runs on a flexible printed circuit film layer, comprising:

a plurality of flexible electrically conducting contact elements mounted on said relatively rigid printed circuit board in a linear array;

means for supporting said flexible printed circuit film layer in a position whereby said exposed conductor runs are predictably located to be aligned with said contact elements;

means for guiding the insertion or removal of said relatively rigid printed circuit board to or from a position whereby said contact elements are aligned with and compressed against said exposed conductor runs on said flexible printed circuit film layer.

7. A system as in claim 6, further including means for latching said relatively rigid printed circuit board in its fully inserted position within said guiding means and means for releasing said latching means and allowing removal of said relatively rigid printed circuit board from said guiding means.

* * * * *